US006608905B1

(12) United States Patent
Muza et al.

(10) Patent No.: US 6,608,905 B1
(45) Date of Patent: Aug. 19, 2003

(54) MICROPHONE BIAS CURRENT MEASUREMENT CIRCUIT

(75) Inventors: John M. Muza, Plano, TX (US); Roberto Sadkowski, Plano, TX (US); Martin Sallenhag, Lund (SE); Heino Wendelrup, Malmoe (SE)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/216,698

(22) Filed: Dec. 18, 1998

Related U.S. Application Data

(60) Provisional application No. 60/068,225, filed on Dec. 19, 1997.

(51) Int. Cl.[7] ..... H04R 3/00
(52) U.S. Cl. ..... 381/111; 381/120; 330/262
(58) Field of Search ..... 381/111, 112, 381/113, 114, 120; 330/262, 273

(56) References Cited

U.S. PATENT DOCUMENTS 5,627,494 A * 5/1997 Somerville ..... 330/257
5,832,076 A * 11/1998 Holthaus et al. ..... 379/387.02
5,838,804 A * 11/1998 Holthaus et al. ..... 381/111

* cited by examiner

*Primary Examiner*—Forester W. Isen
*Assistant Examiner*—Brian Pendleton
(74) *Attorney, Agent, or Firm*—Alan K. Stewart; W. James Brady, III; Frederick J. Telecky, Jr.

(57) ABSTRACT

A microphone bias current detection circuit includes: a microphone circuit 18; an amplifier 10 having a first output and a second output, the first output is coupled to the microphone circuit 18 for providing a bias current to the microphone circuit 18, the second output provides a sampled current $I_s$ proportional to the bias current; a first switch 30 having a first end coupled to the second output of the amplifier 10; a resistor 38 having a first end coupled to a second end of the first switch 30; and a second switch 32 coupled between the first end of the resistor 38 and a reference current source.

4 Claims, 1 Drawing Sheet

MICROPHONE BIAS CURRENT MEASUREMENT CIRCUIT

This application claims priority under 35 USC § 119 (e) (1) of provisional application No. 60/068,225 filed Dec. 19, 1997.

FIELD OF THE INVENTION

This invention generally relates to electronic systems and in particular it relates to microphone bias current measurement circuits.

BACKGROUND OF THE INVENTION

The current microphone of choice in the telecom industry is an electret microphone. This particular type of low cost microphone needs a bias current flowing through it to maintain proper operation.

SUMMARY OF THE INVENTION

Generally, and in one form of the invention, the microphone bias current detection circuit includes: a microphone circuit; an amplifier having a first output and a second output, the first output is coupled to the microphone circuit for providing a bias current to the microphone circuit, the second output provides a sampled current proportional to the bias current; a first switch having a first end coupled to the second output of the amplifier; a resistor having a first end coupled to a second end of the first switch; and a second switch coupled between the first end of the resistor and a reference current source.

DETAILED DESCRIPTION OF PREFERRED EMBODIMENTS

Figure 1:
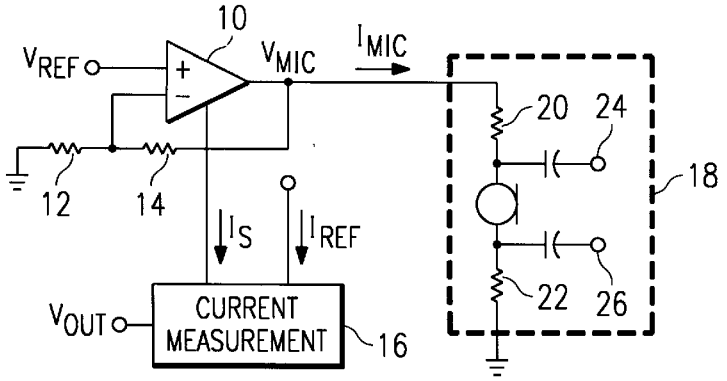
FIG. 1 is a schematic circuit diagram of a preferred embodiment microphone bias current detection circuit.

FIG. 1 is a circuit schematic illustrating a preferred embodiment microphone bias current detection circuit. The circuit of FIG. 1 provides an output signal which indicates how many microphones are connected to the circuit. The circuit of FIG. 1 includes amplifier 10; resistors 12 and 14; current measurement circuit 16; microphone circuit 18 which includes resistors 20 and 22, and microphone input nodes 24 and 26; reference current $I_{ref}$; reference voltage $V_{ref}$; microphone current $I_{mic}$; microphone voltage bias level $V_{mic}$; sampled current Is; and output voltage $V_{out}$. Example values for the resistors in the circuit of FIG. 1 are 175 K ohm for resistor 12 and 30 K ohm for resistor 14. An example reference voltage $V_{ref}$ is 1.7 Volts. Sampled current $I_s$ is proportional to microphone current $I_{mic}$. In the preferred sampled current $I_s$, has a value of 10% of microphone current $I_{mic}$. Microphone circuit 18 supports a fully differentiated signal with nodes 24 and 26. The circuit of FIG. 1 can have additional microphones in parallel with microphone circuit 18. The additional microphones would be similar to microphone circuit 18. The current measurement circuit 16 converts sampled current $I_s$ into an output voltage $V_{out}$ representative of the number of microphones connected to the circuit. Reference current $I_{ref}$ is used for calibration of measurement circuit 16.

Figure 2:
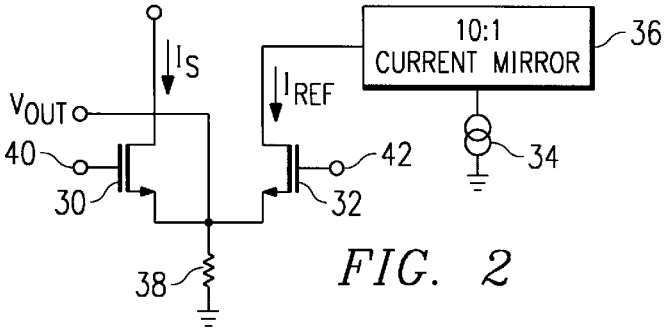
FIG. 2 is a schematic circuit diagram of a measurement circuit shown in FIG. 1.

FIG. 2 is a circuit diagram of the measurement circuit 16 shown in FIG. 1. The circuit of FIG. 2 includes transistors (switches) 30 and 32, current source 34, cascode current mirror 36, resistor 38, output voltage $V_{out}$, sample current $I_s$, measurement select node 40, reference current $I_{ref}$, and reference select node 42. In the preferred embodiment, current mirror 36 has a ratio of 10:1 such that reference current $I_{ref}$ is ten times the current in current source 34. The circuit of FIG. 2 provides a two phase calibration scheme to remove the process variation error due to the single resistor 38. In the first phase, a well controlled reference current $I_{ref}$ is passed through resistor 38 by turning on transistor 32 while transistor 30 is off. During this calibration phase, output voltage $V_{out}$ provides an accurate measurement of resistor 38. The second phase allows sampled current $I_s$ to pass through resistor 38 by turning on transistor 30 while transistor 32 is off. This second phase an output voltage $V_{out}$ proportional to current $I_{mic}$ in FIG. 1. This two phase scheme allows for a calibration step to improve the accuracy of the result. This scheme can power down so no extra current is wasted in non-operation times. The nominal value of the resistor 38 and reference current $I_{ref}$ are determined such that a fullscale output $V_{out}$ is at the microphone voltage bias level $V_{mic}$ This allows the current mirror 36 to stay in saturation. This scheme provides a measurement error of less than 12%, which is sufficient for this application.

Figure 3:
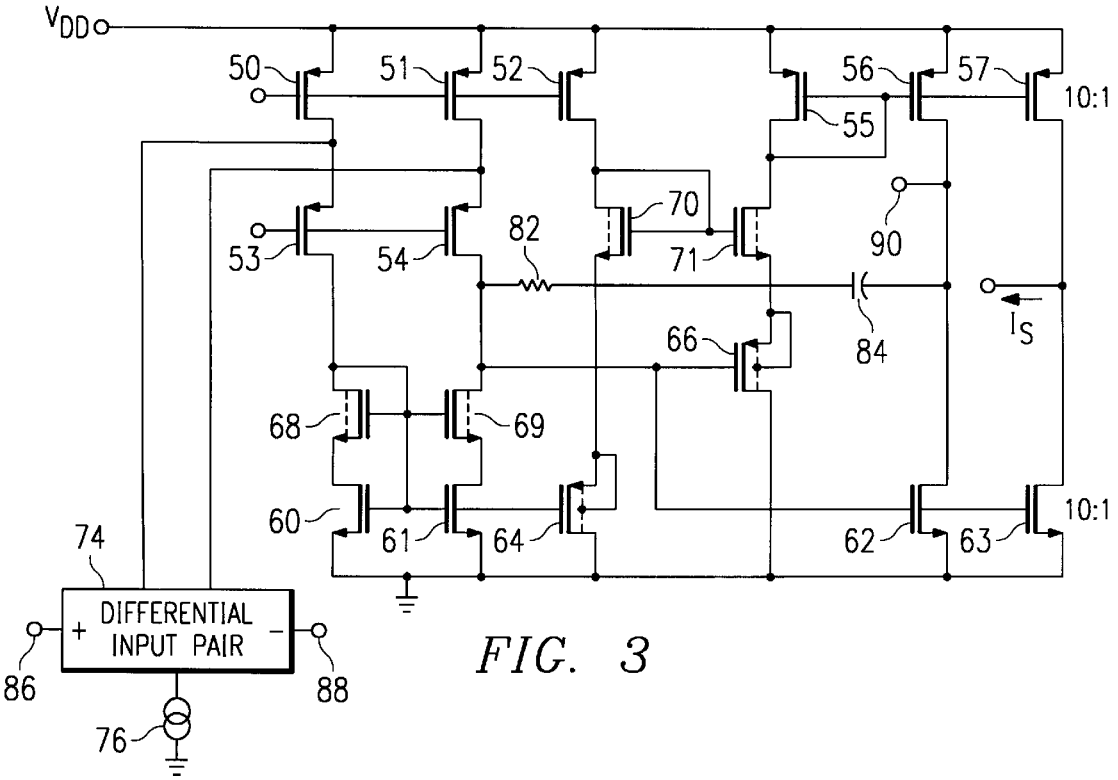
FIG. 3 is a schematic circuit diagram of the output stage of an amplifier shown in FIG. 1.

FIG. 3 is a circuit diagram of the output stage of amplifier 10, shown in FIG. 1. The circuit of FIG. 3 includes PMOS transistors 50–57, NMOS transistors 60–63, low threshold voltage PMOS transistors 64 and 66, low threshold voltage NMOS transistors 68–71, NMOS differential input pair 74, bias current source 76, resistor 82, capacitor 84, positive input terminal 86, negative input terminal 88, output node 90, sample current $I_s$, and source voltage $V_{DD}$. The circuit of FIG. 3 is a good topology for copying the output current $I_{out}$ because amplifier 10 always sources current in this application. This "push-pull" configuration improves overall power dissipation because the NMOS output device 62 can be made very small since the microphone load only sinks current and device 62 is used only for stability purposes. The PMOS transistors 55 and 56 form an accurate current mirror which is easily expanded to include transistor 57 which yields the desired microphone current copy $I_s$ The accuracy of the current copy is further increased when the fullscale output from the circuit of FIG. 2, is at the microphone voltage bias level $V_{mic}$. This ensures the same voltage drop across transistors 56 and 57. This desirable output stage configuration allows a highly accurate copy of the output current $I_{mic}$ for measurement.

This simple two phase microphone bias current gives the end user the ability to optimize the performance of a cellular phone system at a low cost in terms of area, power, and design time.

Although the present invention has been described in detail, it should be understood that various changes, substitutions and alterations can be made without departing from the spirit and scope of the invention as defined by the appended claims. It is therefore intended that the appended claims encompass any such modifications or embodiments.

What is claimed is:

1. A microphone bias current measurement circuit comprising:

a microphone circuit;

an amplifier having a first output and a second output, the first output is coupled to the microphone circuit for providing a bias current to the microphone circuit, the second output provides a sampled current proportional to the bias current;

a first switch having a first end coupled to the second output of the amplifier;

a resistor having a first end coupled to a second end of the first switch; and a second switch coupled between the first end of the resistor and a reference current source.

2. The device of claim 1 wherein the first switch is a transistor.

3. The device of claim 1 wherein the second switch is a transistor.

4. The device of claim 1 wherein the microphone circuit is an electret microphone.

* * * * *